US005784854A

United States Patent [19]

Mazzalveri

[11] Patent Number: 5,784,854

[45] Date of Patent: Jul. 28, 1998

[54] PERFORATING AND PLUGGING DEVICE FOR A MACHINE FOR DISPENSING DYES OR FLUID PRODUCTS IN GENERAL

[75] Inventor: Leopoldo Mazzalveri, Bologna, Italy

[73] Assignee: Corob S.p.A., Medolla, Italy

[21] Appl. No.: 760,747

[22] Filed: Dec. 5, 1996

[51] Int. Cl.[6] ..... B65B 61/20

[52] U.S. Cl. ..... 53/50; 53/266.1; 53/268; 53/270; 141/329; 141/90

[58] Field of Search ..... 53/50, 270, 273, 53/266.1, 484, 268, 327, 319, 468, 109, 381.2; 141/329, 90

[56] References Cited

U.S. PATENT DOCUMENTS

| | | | |
|---|---|---|---|
| 3,888,065 | 6/1975 | Heisler | 53/489 |
| 3,912,535 | 10/1975 | Rauser | 141/90 |
| 4,046,287 | 9/1977 | Hoekstra et al. | 141/329 |
| 4,096,893 | 6/1978 | Harvey, Jr. et al. | 141/329 |
| 4,170,798 | 10/1979 | Krumdieck | 141/329 |
| 4,335,759 | 6/1982 | Pattiniemi et al. | 141/329 |
| 4,564,138 | 1/1986 | Bethell et al. | 53/403 |
| 4,597,245 | 7/1986 | Parker | 53/268 |
| 4,951,512 | 8/1990 | Mazza et al. | 141/329 |
| 5,493,840 | 2/1996 | Cane | 53/50 |

FOREIGN PATENT DOCUMENTS

| | | | |
|---|---|---|---|
| 2182912 | 5/1987 | United Kingdom | 141/90 |

*Primary Examiner*—James F. Coan
*Assistant Examiner*—Gene L. Kim
*Attorney, Agent, or Firm*—Sughrue, Mion, Zinn, Macpeak & Seas, PLLC

[57] ABSTRACT

A perforating and plugging device for a dye-dispensing machine comprising at least one output nozzle and a support structure for a container, comprises a perforating member for forming a hole in the container substantially in vertical alignment with the nozzle of the dispensing machine. A plugging member which can house a plug is movable selectively from a rest position to an operative position in order to fit the plug in the hole formed in the container. The perforating member is mounted on a slide element movable horizontally and interacting with articulation means which can move the plugging member, rotating it substantially through an angle of 90° from the rest position to the operative position.

7 Claims, 7 Drawing Sheets

PERFORATING AND PLUGGING DEVICE FOR A MACHINE FOR DISPENSING DYES OR FLUID PRODUCTS IN GENERAL

BACKGROUND OF THE INVENTION

The present invention relates to a perforating and plugging device for a machine for dispensing dyes or fluid products in general. The invention has been developed particularly but not exclusively in connection with a perforating and plugging device which can easily be fitted in combination with a device for moistening the output nozzles of the dispensing machine.

In the varnish- or paint-production field, for example, the final coloured products are produced by the mixing of predetermined quantities of a series of dyes with a generally much larger quantity of a base product, for example a white or transparent base, in accordance with predetermined formulations. The dyes are metered by a dispensing machine from which they are dispensed into a container holding the base. An example of a method for metering dyes and of an automatic dispensing machine is described in the patent EP-B-0198856.

The bases are usually stored in containers which are closed by lids and which, at the required moment and after their lids have been taken off, are placed on a support shelf of the dispensing machine under the output nozzles. If this operation is carried out manually, there is a risk of some of the contents of the container being spilt either before or after the dye-dispensing operations. Above all, manual opening of a container involves a considerable waste of time.

In some cases, the containers are not opened completely but their tops are perforated to reduce the risk of the product coming out, the hole then being closed by a pressure plug upon completion of the dispensing operations. However, greater care then has to be taken in the positioning of the container under the nozzles of the dispensing machine to ensure that they are aligned vertically with the hole in the container. This disadvantage increases production times and also introduces the risk of production rejects or inaccuracy in the production of the desired colour should some of the dye not go into the container.

SUMMARY OF THE INVENTION

The object of the present invention is to solve the problems of the prior art by means of a perforating and plugging device which reduces the times taken to produce the finished products, which eliminates the risk of wastage of the base product or of dye or, in general, of the fluid products dispensed by a dispensing machine, and which enables the machine to be used even by unskilled people or at least makes it easier, quicker and more convenient to use, even for large production volumes. Another object of the present invention is to provide a perforating and plugging device which is easy to manufacture, fit and maintain, and which can be produced in versions suitable for both industrial and small-scale use.

In order to achieve the object indicated above, the subject of the present invention is a perforating and plugging device for a machine for dispensing dyes and fluid products in general, characterized in that it comprises:

- a support structure for at least one container which is intended to receive fluid products dispensed by at least one nozzle of the dispensing machine,
- a perforating member which, in use, is intended to form a hole in a predetermined upper portion of the container substantially in vertical alignment with the at least one nozzle of the dispensing machine,
- a plugging member comprising a housing element movable selectively from a rest position in which the housing element is accessible from the front to receive a plug to an operative, plugging position in order, in use, to fit the plug in the corresponding hole formed in the container by the perforating member,
- drive means for moving the plugging member from the rest position to the operative position in which the plug is substantially in vertical alignment with the at least one nozzle of the dispensing machine and, consequently, with the hole formed in the container by the perforating member.

An advantage of the present invention is that it is not necessary, during dispensing operations, to reposition the container under the perforating member, under the nozzles, or under the plugging member. To simplify the positioning of the container under the nozzles, the hole is normally formed in the centre of the circular, upper face of the container. The central position of the hole may not always be convenient for the final user who is forced to turn the container over in order to remove its contents completely.

The formation of a hole which is not centred in the upper portion of the container, which may be more convenient and pleasing to the final user, however, makes it more difficult to position the container under the nozzles of the dispensing machine with the use of the systems of the prior art. In fact, in this case, it is necessary to rotate the container manually about its vertical axis and to check visually that the hole is positioned under the delivery nozzles. A further advantage of the present invention is that the container may be perforated in any portion of its upper face, for example, near the cylindrical side wall, so as to facilitate the removal of the fluid product by the final user, in this case also overcoming the disadvantages of the prior art. The selection of the position of the hole in the container thus no longer depends upon the need to simplify the dispensing process.

Another object of the present invention is to provide a perforating and plugging device which is or can be integrated with a device for moistening the nozzles of a dispensing machine, reducing the time during which the nozzles are exposed to the outside atmosphere to the minimum, in order to prevent the known drying phenomenon.

In order to achieve these objects, the subject of the present invention is a perforating and plugging device of the type indicated above, characterized in that the perforating member is coupled to a device for moistening the at least one nozzle of the dispensing machine and is movable selectively from the perforation position to a position of disengagement in order to free the at least one nozzle from the moistening device and to enable the fluid products to be dispensed through the hole in the container.

An advantage of the association with the moistening device is that, essentially, the nozzles are uncovered only for the time necessary for the dispensing and not throughout the time necessary for the perforation and plugging of the container also.

The device may be operated manually or automatically. In the latter case, the perforating member, the plugging member and the moistening device, when provided, can be connected to a movable body, particularly a slide body, driven by an electric motor the control circuits of which can be connected to or interfaced with the devices for automatically controlling the fluid-dispensing operations.

BRIEF DESCRIPTION OF THE DRAWINGS

Further characteristics and advantages will become clear from the following description of a preferred embodiment, given way of non-limiting example with reference to the pended drawings, in which.

DETAILED DESCRIPTION OF THE INVENTION

Figure 1:
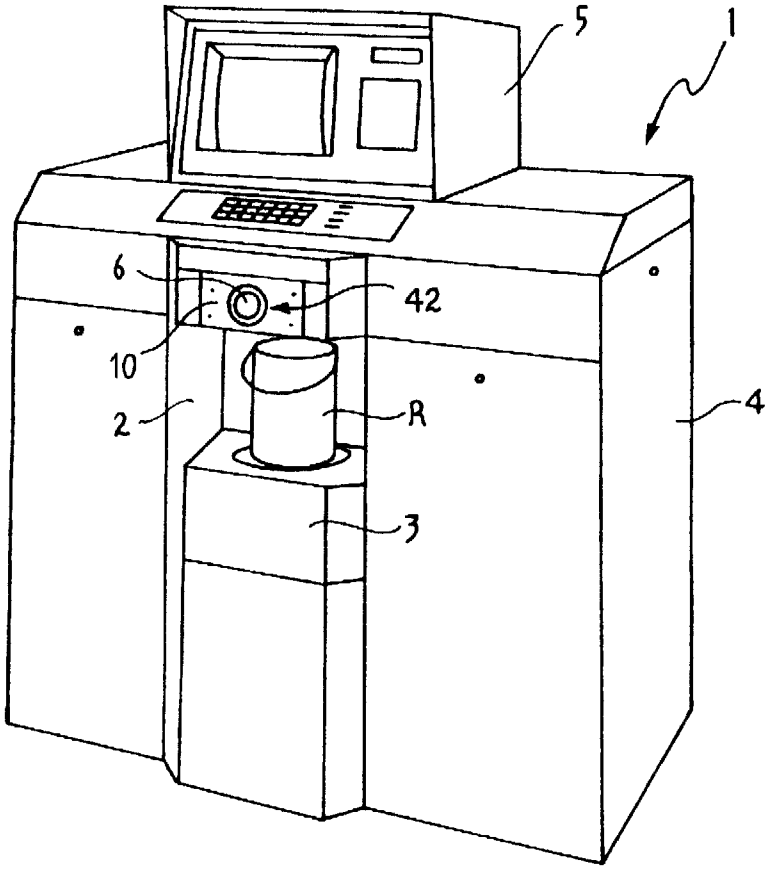
FIG. 1 is a thematic, perspective view of an automatic dispense machine comprising a device according to the present invention.

With reference now to FIG. 1, an automatic dispensing machine 1 comprises a space 2 in which a shelf 3 is mounted for sliding vertically, a container R, into which predetermined quantities of fluids contained in reservoirs housed in a casing 4 are to be dispensed, being placed on the shelf 3. Naturally, the dispensing machine may have a configuration other than that shown and, for example, may comprise a projecting dispensing head facing a vertically-movable member which in turn may be integrated in system for the manual or automatic supply or handling of the containers such as, for example, a roller system, a movable belt, or the like.

The dispensing operations are controlled by an electronic circuit, possibly connected to a user interface. The characteristics of the dispensing machine and the dispensing methods are not considered since they are already known in the art and do not fall within the scope of the present invention. A perforating and plugging device 10 fitted on the machine comprises a plugging member 42 which, as explained further below, can house a plug 6.

The perforating and plugging device 10 which is shown in greater detail in FIG. 2, comprises a perforating member 12 mounted on a slide 14 movable horizontally on guides fixed below the dispensing head 16 of the dispensing machine, the head being disposed in the space 2 above the shelf 3 of FIG. 1. The slide is moved horizontally by the activation of an electric motor 15, preferably a direct-current motor, connected to a pinion which meshes with a rack fixed to the slide 14. Naturally, the slide 14 may be moved by other mechanisms, for example, by a worm screw, a rod, an electric or hydraulic actuator, a jack or any other linkage, transmission or mechanism driven by an electric, pneumatic, hydraulic or equivalent motor of any kind.

Figure 3:
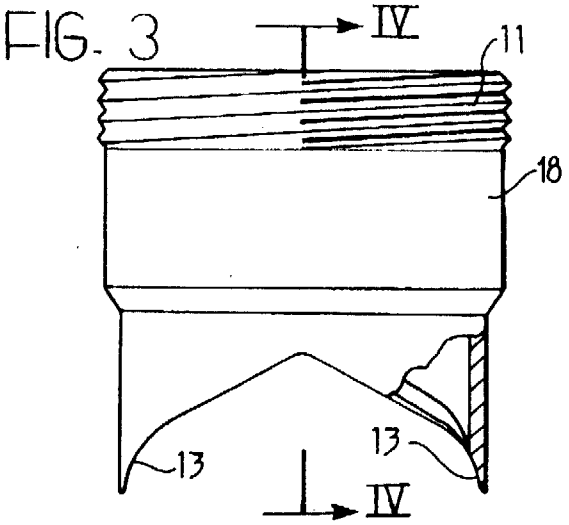
FIG. 3 is side view of a punch of the device of FIG. 2, on an enlarged scale.
Figure 4:
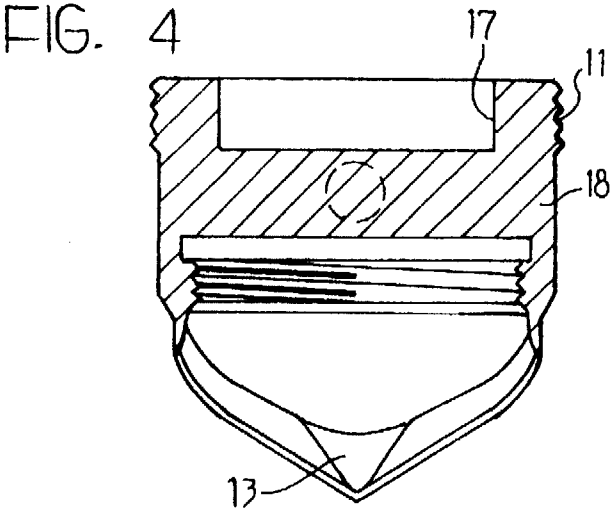
FIG. 4 section taken on the line IV—IV of FIG. 3.
Figure 2:
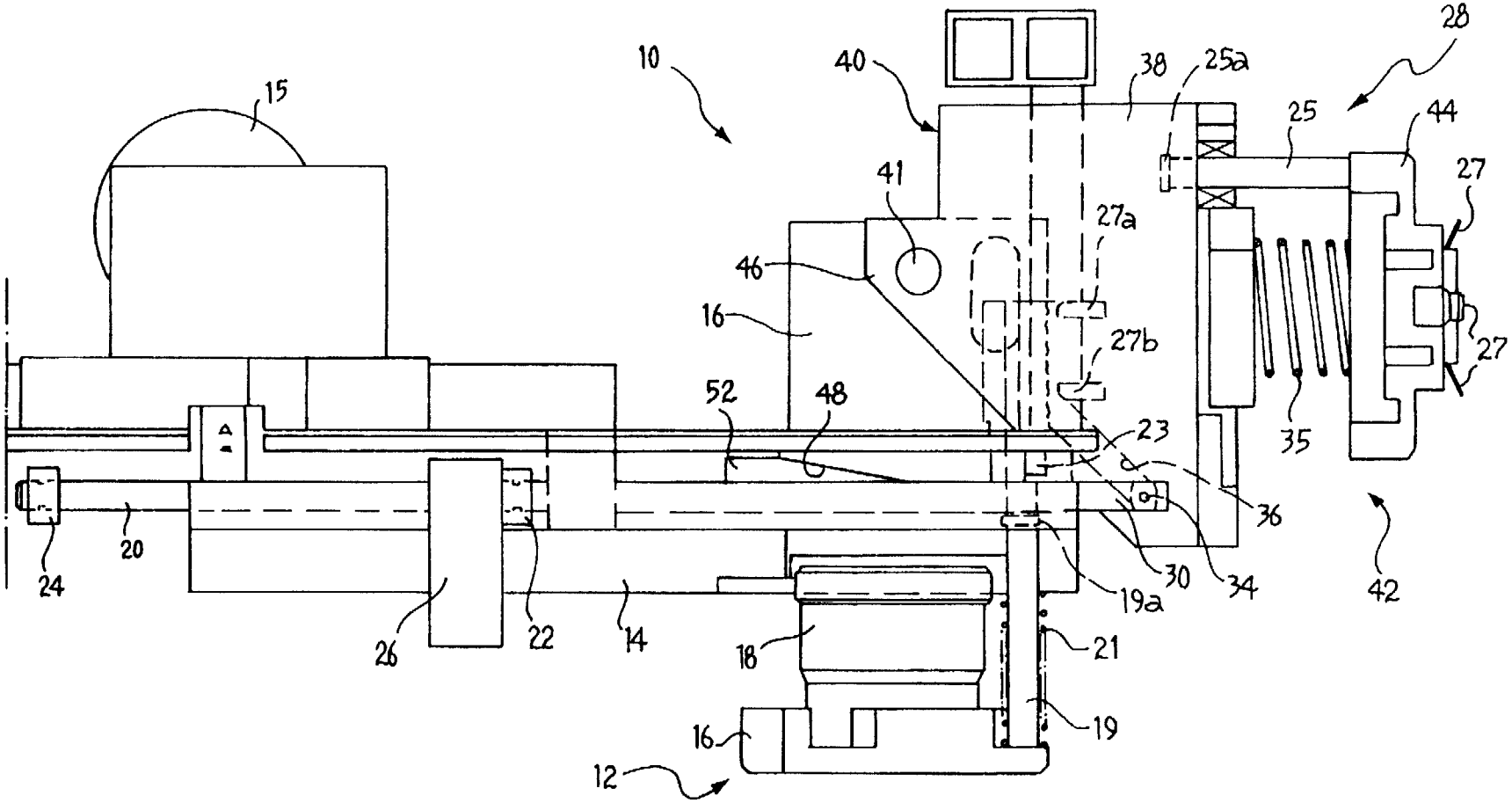
FIG. 2 is a lateral section of a perforating and plugging device according to the present invention.

A punch 18 which, as can be seen in FIGS. 3 and 4, has an external thread 11 in its upper portion and shaped blades 13 in its lower portion, is screwed into the slide 14, which has a hole which is opposite the supply head 16 when the perforating and plugging device is in its rest position shown in FIG. 2. The upper wall of the punch 18 has a recess 17 for housing a pack of material impregnated with water or solvent or, in any case, a compound suitable for keeping the fluids dispensed by the machine moistened and preventing their drying out, which would lead to blockage of the output nozzles.

With reference once more to FIG. 2, the perforating member 12 comprises a ring 16 from which a plurality of guide rods 19, of which there are preferably, but not necessarily, four, extend vertically, the rods being able to slide freely in through-holes in the slide 14. The maximum downward travel of the ring 16 is defined by travel-limit stops 19*a* on the upper ends of the guide rods 19. A plurality of helical springs 21 wound around the guide rods 19 resiliently opposes upward movement of the ring 16. The axis of a control pin 23 mounted for sliding on the structure of the dispensing machine, or in any case, on the support: structure of the slide 14, coincides with the axis of one of the guide rods 21 in the rest position of the device 10 shown in FIG. 2. Sensors 27*a*, 27*b*, the function of which will be described further below, are associated with the control pin 23.

A bar 20 mounted for sliding horizontally on the slide 14 has a pair of adjustable stops, that is, a front stop 22 and a rear stop 24. The stops 22, 24 are disposed on opposite sides of an appendage 26 fixed to the slide.

A transverse pin 34 mounted at the front end 30 of the rod 20, that is, the end pointing towards the front portion 28 of the metering machine, on the right-hand side in FIG. 2, is movable in a slot 36 formed in the side wall 38 of a support yoke 40 of the plugging member 42. In order to distribute the lateral thrusts evenly on the bar 20, the front end is preferably fork-shaped.

Figure 5:
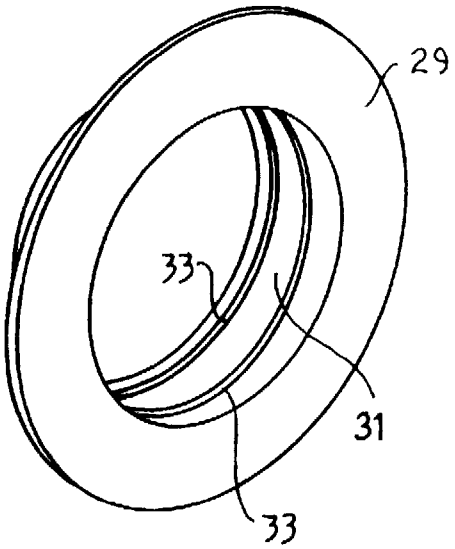
FIG. 5 is a perspective view of a plug usable with the device of FIG. 2, on an enlarged scale.

A plurality of sliding guide rods 25, just like the guide rods of the perforating member 12 and also having travel limit abutments 25*a* at one end, is mounted on the support yoke 40. The opposite ends of the guide rods 25 support a plug-holder plate 44 having a ring of flexible tongues 27 for holding a plug 29, shown in FIG. 5. In greater detail, the plug 29 comprises a cylindrical wall 31 with internal annular ribs 33 which are engaged by the resilient tongues 27 of the plugging member 42.

A central helical spring 35 resiliently opposes the movement: of the plug-holder plate 44 towards the support yoke 40 of the plugging member 42. Naturally, it is possible to adopt the solution used for the perforating member 12, that is, the use of helical springs wound around each guide rod for the guide rods 25 of the plugging member 42, and vice versa. The support yoke 40 is articulated to a bracket 46 fixed to the support of the member 10 by means of an articulation rod 41. The yoke 40 can thus pivot relative to a transverse axis perpendicular to the direction of sliding of the slide 14 and of the rod 20. The slot 36 is elongate in a direction such as to be inclined at 450 to the horizontal axes of the guides of the slide 14, as can be seen in FIG. 2.

Naturally, according to the size of the device 10, to its mass and, consequently, to the inertial forces which develop during its movement, more than one bar 20 may be provided, for example, two bars may be arranged parallel to the two sides of the device 10.

The perforating and plugging device 10 is mounted on the dispensing machine in a manner such that, in the rest position shown in FIG. 2, the lower wall 48 of the dispensing head 16, in which the ducts for dispensing the dyes open, and which will be referred to below by the term "nozzle centre", is disposed substantially in vertical alignment with the perforating member 12. In a preferred embodiment, the lower wall 48 of the nozzle centre is inclined like a ramp so that, in the rest position of the device, it is coupled with a complementary annular plate 52 fixed to the slide 14. The annular plate 52 is internally threaded for the mounting of the punch 18 as described above. Preferably, a toroidal seal or O-ring mounted on the annular plate 52 isolates the nozzle centre 48 from the outside atmosphere in the rest position of the device 10, permitting effective moistening by the material housed in the recess 17 of the punch 18.

The perforating member 12, and the device 10 in general, are mounted on the dispensing machine in the space 2 above the shelf 3 for supporting the container R into which the dyes are to be dispensed. In an automated embodiment of the perforating the plugging device 10, the shelf 3 is movable vertically on guides and is connected to an electric motor with the interposition of, for example, a rack and pinion transmission.

Naturally, it is possible to provide for alternative methods of moving the shelf, in particular, by means of worm screws, electric or hydraulic actuators, jacks, telescopic actuators and the like, or even by manually-operated linkages or mechanisms. If the shelf 3 is moved automatically, it is particularly advantageous to provide a control system for the actuator device so that the speed of the rise or descent of the shelf can be regulated discretely or continuously. In particular, it is especially advantageous to provide for at least two operative speeds of the vertical movement of the shelf 3, a first, faster speed to reduce the times taken for loading and unloading of the container R, and a second, slower speed for the fine adjustment of the position of the container R under the perforating and plugging unit 10, in accordance with the method of operation which will be described further below.

A variant of the moistening device which is particularly suitable for dispensing machines for which the container is loaded manually comprises a cover 60, preferably having a resilient and shaped peripheral lip 60*a*, and articulated to the support structure of the perforating and plugging device 10 or to the structure of the dispensing machine by means of an articulated-quadrilateral lever linkage comprising two pairs of levers 62, 64. Each of the rear levers 64 carries a pin 66 which slides in a slot 68 formed in a respective lateral arm 70 of a fork 72. When a container R is introduced into the space 2 in a dispensing machine provided with the moistening device, the side wall of the container urges the fork 72 rearwardly in the direction indicated by the arrow A so as to clear the nozzle centre 48*a* for dispensing operations. A sensor 76 supplies a consent signal for the delivery operations to start when the nozzle centre 48*a* is clear of the moistening device.

Figure 6:
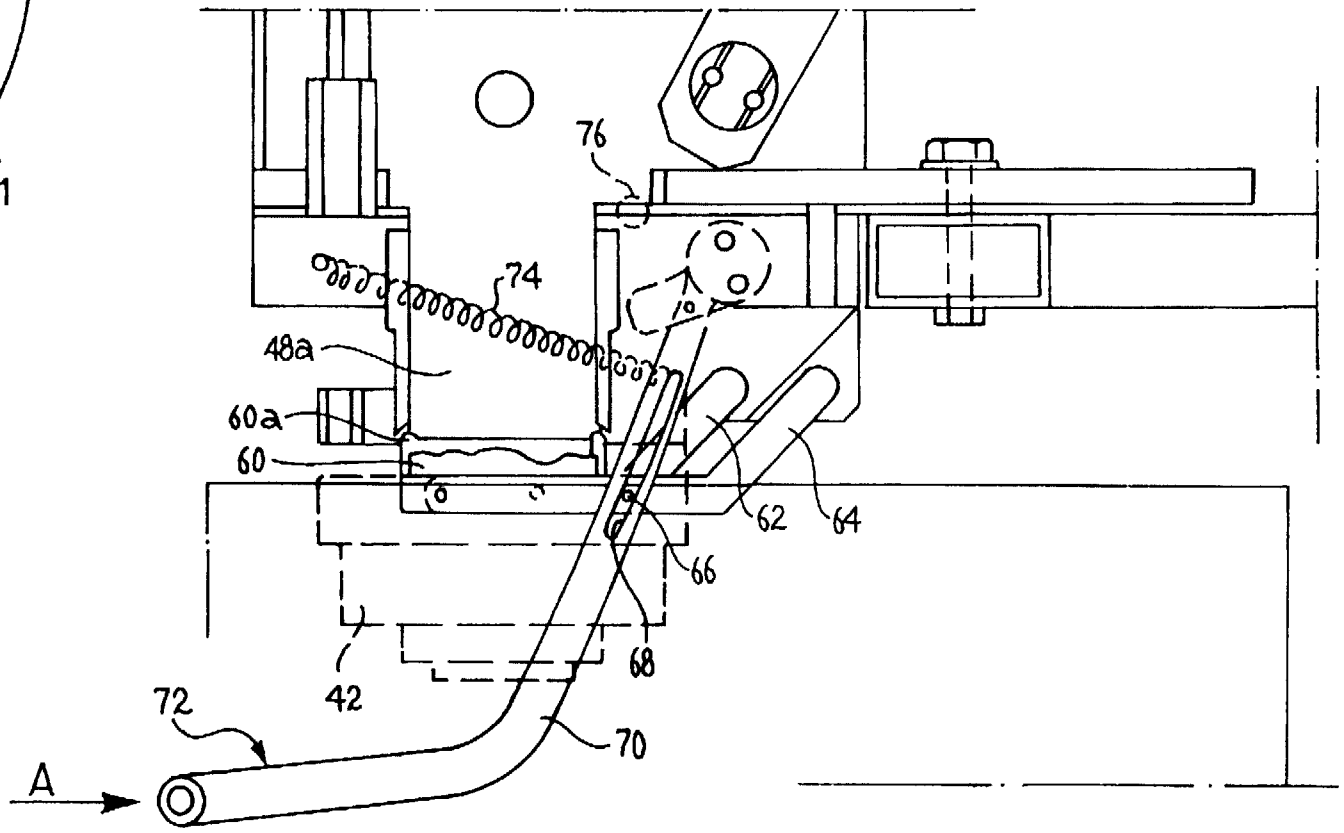
FIG. 6 shows a variant of the moistening member of a device formed according to the present invention.

A biasing spring 74 returns the moistening device to the position shown in FIG. 6 when the container is removed from the space 2 upon completion of the perforation, dispensing and plugging operations. FIG. 6 also shows, in broken outline, the position adopted by the plugging member 42 during the plugging of the container R.

During the use of the perforating and plugging device 10 shown in FIG. 2, a closed container R, which usually contains a base product and into which one or more dyes are to be dispensed, is placed on the vertically movable shelf 3. If the container is placed on the shelf manually, a closure door equipped with sensors (not shown in FIG. 1) or other known safety systems prevents the activation of the dispensing cycle, supplying a preventing signal to the computer 5.

Before the delivery operations are activated, a plug 29 is positioned, automatically or manually, on the plug-holder plate 44 which is accessible to an operator from the front. A sensor may be associated with the plug-holder plate 44 for supplying the computer 5 with a consent signal for the delivery operations to start only if the presence of the plug 29 is detected.

The delivery operations start, first of all, with the raising of the shelf 3 and the container R disposed thereon until the top of the container is perforated by the blades 13 of the punch 18. During this stage, the rest position of the device 10 is that shown schematically in FIG. 7. In a preferred embodiment, the container R approaches the punch 18 at a first, faster speed with a subsequent change to a second, slower speed during the perforation. Whilst the punch 18 is perforating the top of the container R, it urges the ring 16 upwards, overcoming the resilient opposition of the springs 21 and consequently urging the control pin 23 upwards by the movement of the guide rod 19 coaxial with the pin. An upper travel-limit position of the control pin 23 is detected by the "fully up" sensor 27*a* which supplies the electronic control circuit with a signal indicating the end of the perforation stage. The electronic circuit consequently causes the shelf 3 to move downwards far enough to release the top of the container R from the blade of the punch 18.

The configuration of the blade 13 of the punch 18 is such as to cut a disc of sheet metal from the top of the container without detaching it completely but bending it towards the inside of the container R. The fact that the portion of cut sheet metal is not freely movable inside the container R results, in the first place, in greater safety for the final user if he should decide to open up the container R completely. In this case, the removal of the lid of the container R also removes the cut sheet-metal disc which can be removed, reducing risks of cuts or injury to the user. In the second place, the fact that the cut sheetmetal disc remains attached to the lid of the container R prevents the fluids held in the container R from being tainted or contaminated by the disc.

Figure 8:
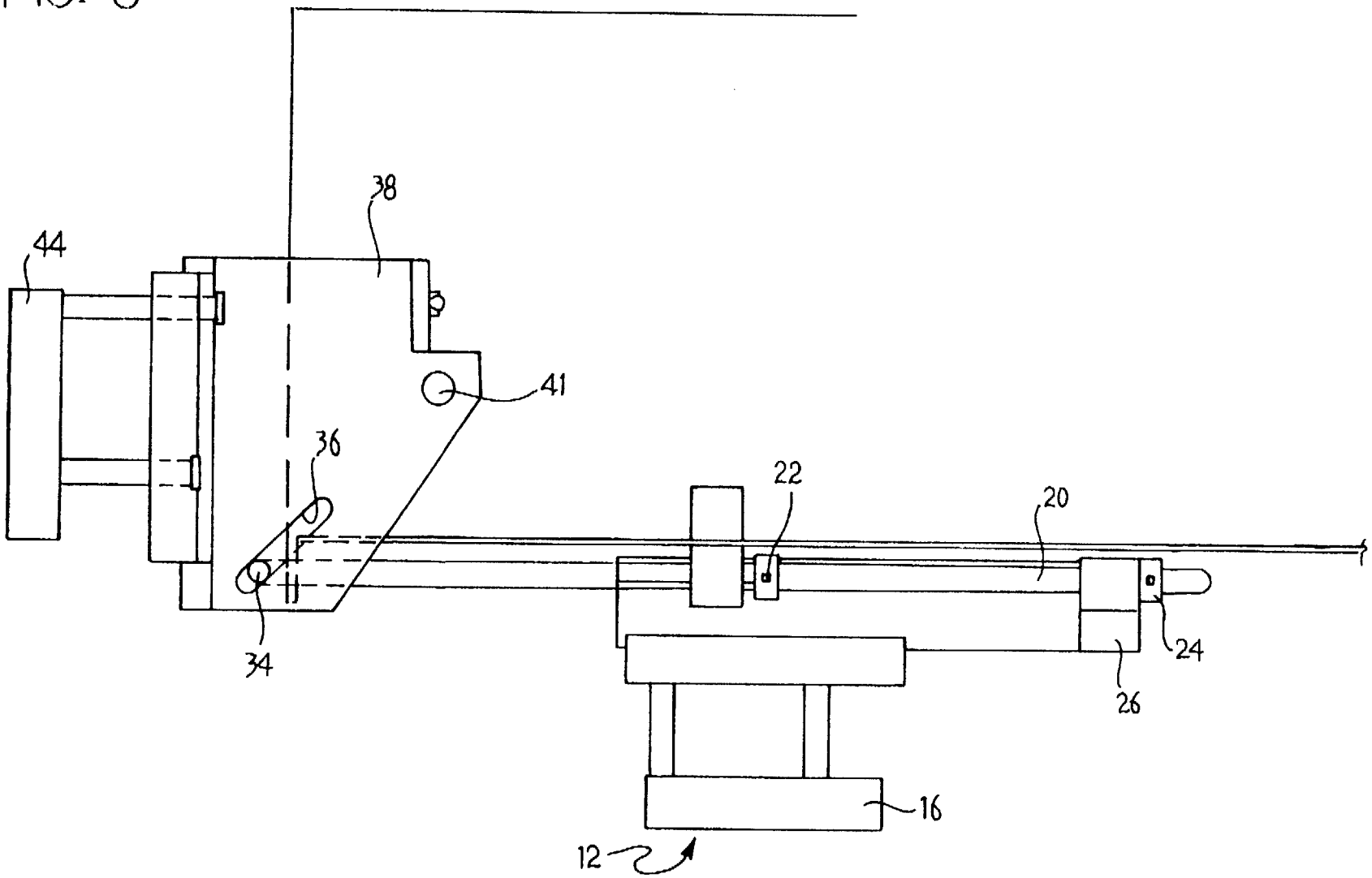

In the next stage, the electric motor 15 is energized so as to retract the slide 14 which entrains the annular plate 52, the punch 18 and the perforating member 12 as a whole, freeing the nozzle centre 48, as shown schematically in FIG. 8. At this point, the actual dispensing of the dyes into the container R through the hole previously formed in its top can start. The electric motor 15, and hence the device 10, are stopped in the delivery position shown in FIG. 8 by a signal supplied to the computer 5 by a proximity sensor or by a microswitch.

Figure 9:
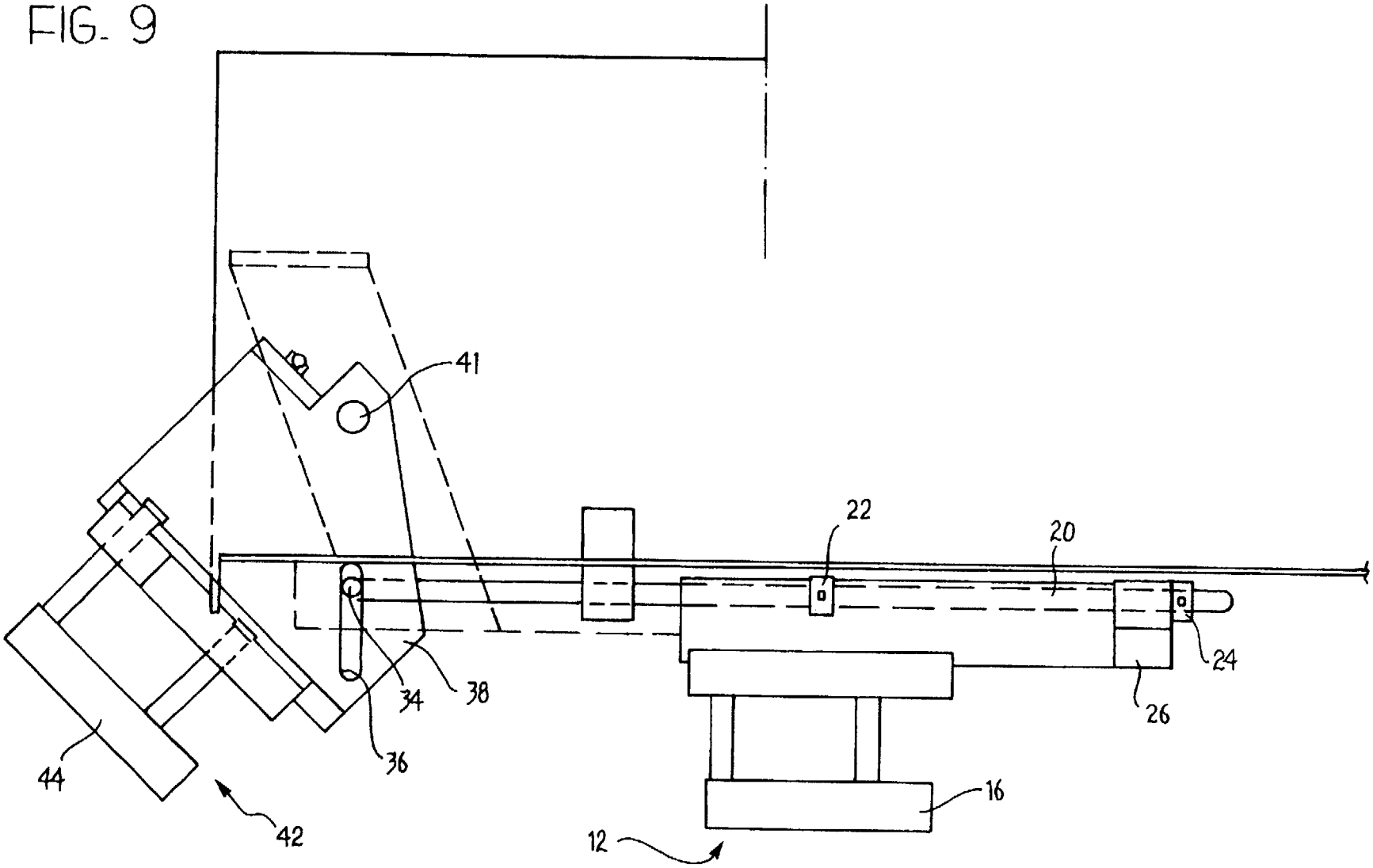
Figure 10:
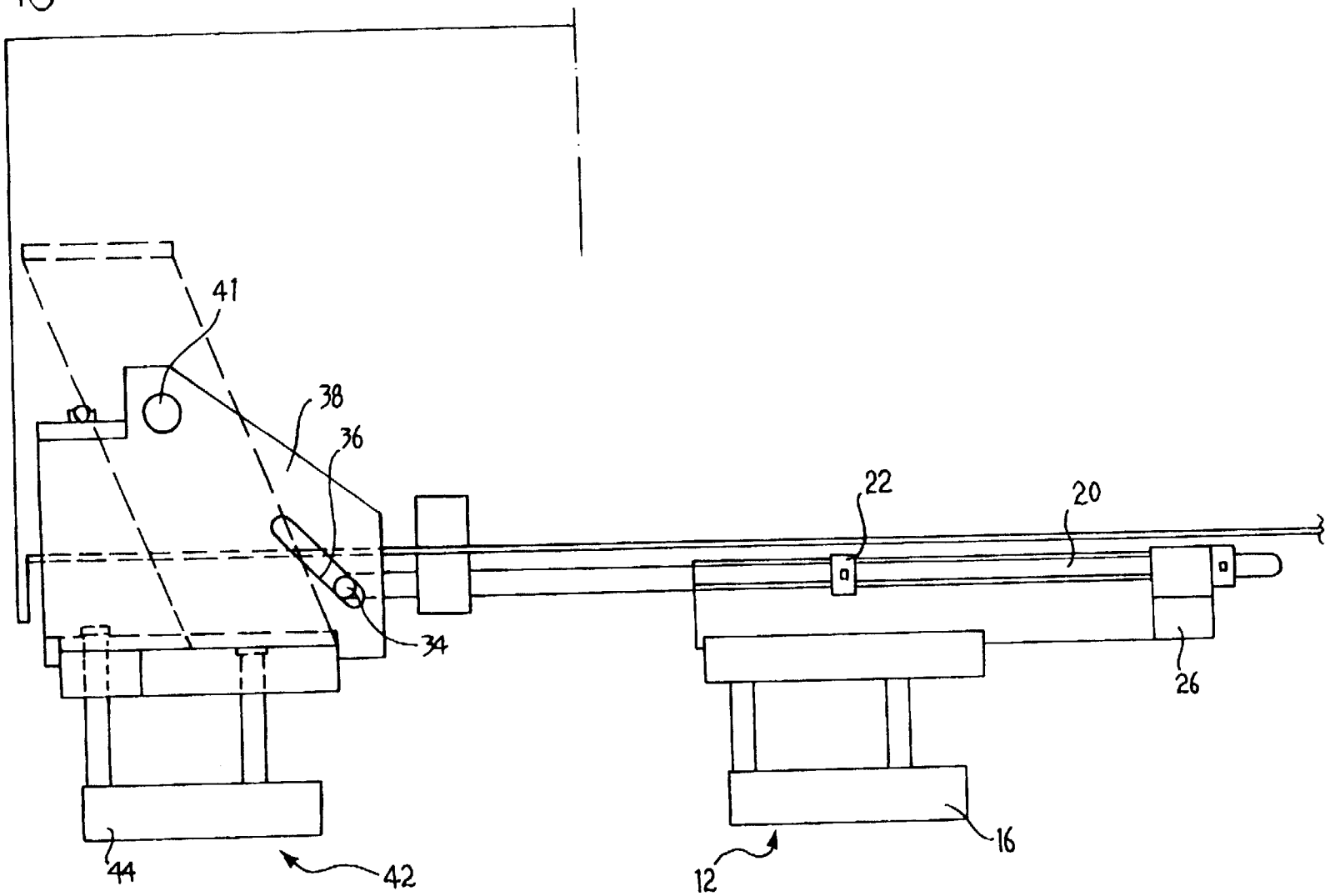

Upon completion of the delivery stage, the electric motor 15 is energized again so as to retract the slide 14 further. During the retraction movement of the slide, the appendage 26 runs into the stop 24 and entrains with it the bar 20 which pivots the yoke 40, and hence the plugging member 42 as a whole, by means of the pin 34, as shown in FIG. 9. Upon the reaching of the position shown in FIG. 10, which is indicated by another proximity sensor, the electric motor 15 is de-energized. In this configuration, the plugging member 42 has reached a position substantially corresponding to the position occupied by the perforating member before the start of the delivery operations. The shelf 3 is raised again so that the plug 29 is inserted in the hole previously formed in the container R by the punch 18. The guide rod 25 of the plugging member 42 which is coaxial with the control pin 23 raises it in the same manner as described with reference to the perforating member, so as to indicate to the computer the reaching of the "fully up" condition in which the plug is correctly inserted in the hole in the container R. The interference between the plug 29 and the hole in the container R causes the tongues 27 to bend, with the help of the subsequent downward movement of the shelf 3, consequently detaching the plug from the plate 44.

Figure 7:
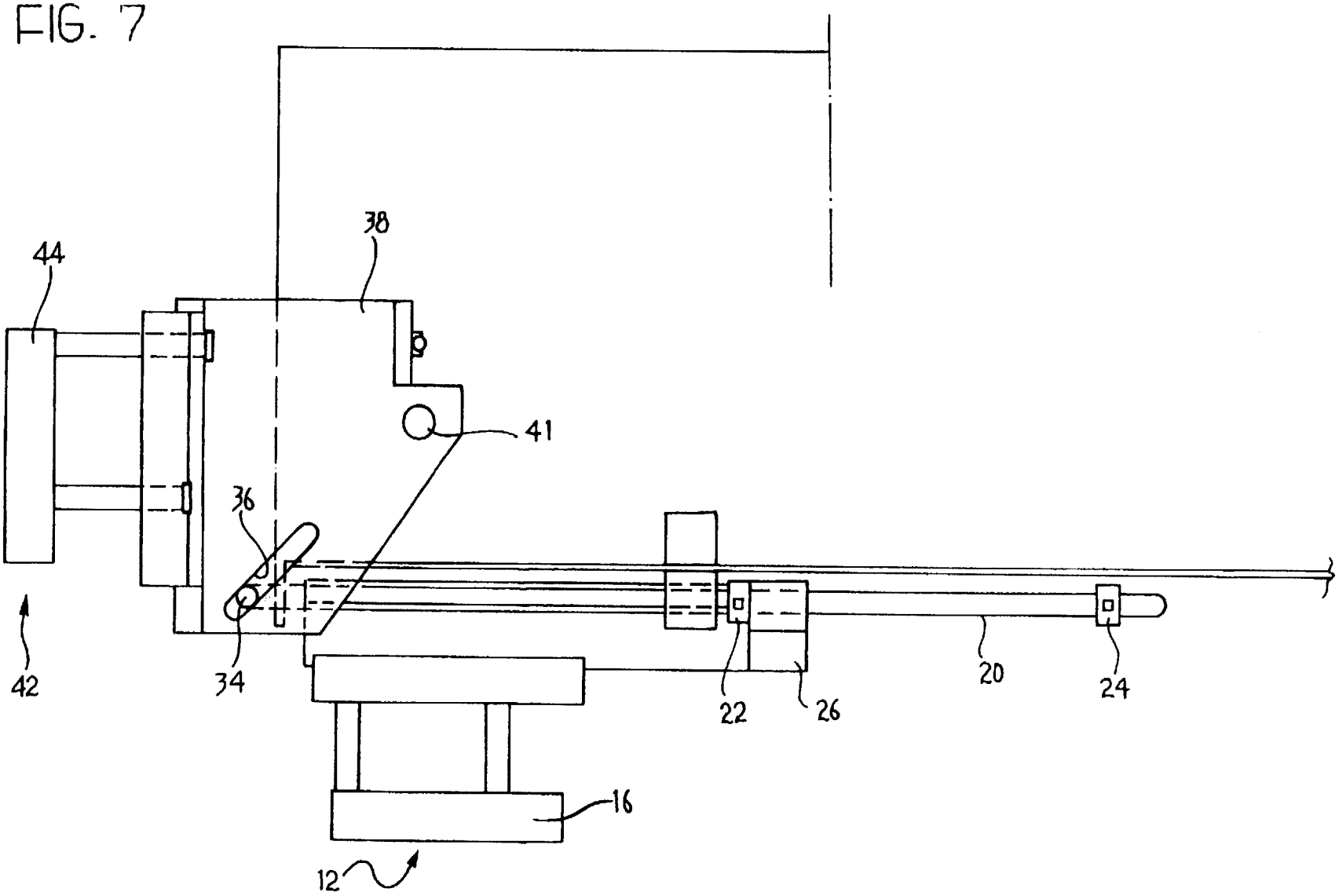
FIGS. 7, 8, 9 and 10 show the perforating and plugging device of FIG. 2 schematically, in different operative configurations.

The slide 14 is then brought back to the rest position of FIG. 7. The plugging member 42 is returned to its rest position by the thrust exerted by the appendage 14 on the front stop 22 or, alternatively or in addition, by the movement imparted by resilient biasing elements of the yoke 40, for example, by torsion springs coaxial with the articulation pin 41, which urge the plugging member 42 to the position of FIGS. 2 and 7. The further sensor 27*b* preferably checks that the control pin 23 has reached a "fully down" position, corresponding to the guide rods 25 of the plugging member having slid down fully, before supplying the computer with a consent signal for the activation of the advance of the slide 14.

In the rest position, the nozzle centre 48 is closed at the bottom again by the annular plate 52 and by the punch 18 which, since it carries the moistening material within it, prevents drying of the dye still present in the delivery ducts.

In a variant of the device described above, the lower wall 48 of the nozzle centre is flat and is also closed by a moistening device carried by the plugging member during the plugging of the container. This method of operation, which, in practice, reduces the time during which the nozzle centre is in contact with the air solely to the dispensing period, can be implemented, in particular, in a variant of the perforating and plugging device in which the plugging member is disposed parallel to the perforating member and mounted on the same slide. Although this solution is more inconvenient for an operator who has to fit a plug on the plugging member, it simplifies the movement mechanisms of the member which is always moved parallel to itself without pivoting.

A further variant may provide for the container to remain positioned on a fixed support and for the perforating and plugging device to be moved vertically, for example, by the mounting of the slide on vertical guides, or may even provide for independent vertical movement of the perforating unit and of the plugging unit. The vertical movement of the device as a whole or of the perforating and plugging units individually may be brought about either manually or automatically.

Naturally, the principle of the invention remaining the same, the forms of embodiment and details of construction may be varied widely with respect to those described and illustrated, without thereby departing from the scope of the present invention.

What is claimed is:

1. A perforating and plugging device for a machine for dispensing dyes or fluid products in general comprising at least one delivery nozzle and a support structure for at least one container, characterized in that it comprises:

a perforating member which, in use, is intended to form a hole in a predetermined upper portion of the container substantially in vertical alignment with the at least one nozzle of the dispensing machine, a plugging member comprising a housing element movable selectively from a rest position in which the housing element is accessible from the front to receive a plug to an operative, plugging position in order, in use, to fit the plug in the corresponding hole formed in the container by the perforating member, and drive means for moving the plugging member from the rest position to the operative position in which the plug is substantially in vertical alignment with the at least one nozzle of the dispensing machine, and consequently, with the hole formed in the container by the perforating member, wherein the perforating member is coupled to a device for moistening the at least one nozzle of the dispensing machine and is movable selectively from the perforating position to a position of disengagement in order to free the at least one nozzle from the moistening device and to enable fluid products to be dispensed through the hole formed in the container.

2. A perforating and plugging device according to claim 1, characterized in that it comprises a horizontally-movable element, the perforating member being mounted on the movable element and the plugging member being connected to the movable element and being able to pivot substantially through an angle of 90° as a result of a translational movement the movable element.

3. A perforating and plugging device according to claim 2, characterized in that the movable element comprises an appendage in which at least one bar connected to the plugging member is mounted for sliding horizontally, a rear abutment element being mounted in a fixed position on the at least one bar in order to entrain the plugging member, pivoting it to the plugging position as a result of a rearward translation of the movable element.

4. A perforating and plugging device according to claim 3, characterized in that the at least one bar comprises a fork-shaped front end which is movable in a slot in the side wall of a support yoke of the plugging member.

5. A perforating and plugging device according to claim 2, characterized in that the movable element comprises resilient means for urging the plugging member into the rest position.

6. A machine for dispensing dyes or fluid products in general, comprising at least one delivery nozzle and a support structure for a container into which fluid products are to be dispensed, characterized in that it comprises a perforating member and a plugging member which can be activated selectively in sequence before the start and after the completion of the dispensing of the fluid products, respectively, the perforating member being able to form a hole in a predetermined portion of the container substantially in vertical alignment with the at least one nozzle, and the plugging member being able to fit a plug in the hole in the container along an axis substantially vertically aligned with the at least one nozzle, wherein each of the perforating member and the plugging member includes an annular element, resilient means mounted on each of the perforating member and plugging member for biasing each of said annular elements away from the respective perforating member and plugging member, elevating means for raising a container into engagement with each of said annular elements when vertically aligned and moving each of said annular elements against said resilient means and sensor means for sensing movement of each of said annular elements.

7. A dispensing machine according to claim 6, wherein said elevating means comprises a shelf-like member which is movable vertically in order to move the container selectively towards and away from the perforating member and the plugging member when these are disposed in the position of vertical alignment with the at least one nozzle of the dispensing machine.

* * * * *